US005392720A

United States Patent [19]

Briggs et al.

[11] Patent Number: 5,392,720

[45] Date of Patent: Feb. 28, 1995

[54] FLAME RETAINING NOZZLE TIP

[75] Inventors: Oliver G. Briggs, Jefferson; Donald S. Langille, Worcester; Francis G. Ouellette, Spencer, all of Mass.

[73] Assignee: Riley Stoker Corporation, Worcester, Mass.

[21] Appl. No.: 255,167

[22] Filed: Jun. 7, 1994

[51] Int. Cl.[6] ..... F23D 1/02

[52] U.S. Cl. ..... 110/264; 239/403; 239/404; 239/424; 431/183

[58] Field of Search ..... 110/263, 264, 347; 431/182, 183, 184, 185; 239/399, 403, 404, 424

[56] References Cited

U.S. PATENT DOCUMENTS

| | | | |
|---|---|---|---|
| 4,206,712 | 6/1980 | Vatsky | 110/264 |
| 5,131,334 | 7/1992 | Monro | 110/264 |
| 5,249,535 | 10/1993 | Chung | 110/264 |

*Primary Examiner*—Edward G. Favors
*Attorney, Agent, or Firm*—Mason, Kolehmainen, Rathburn & Wyss

[57] ABSTRACT

A flame retaining nozzle tip for a burner for a pulverized fuel fired furnace receiving a primary stream of pulverized fuel and primary transport and combustion air for discharge into the combustion zone of the furnace comprises a hollow, open-ended, choke or body having an inlet end of generally polygonal flow cross-section for receiving the stream and an outlet end of generally rounded cross-section for accelerating and discharging the stream into the furnace. The outlet end of the choke has a flow cross-sectional area that is less than that of the inlet end to provide choking action. An elongated center element is mounted in coaxial alignment with a central axis of the choke body extending between the inlet and outlet ends. A plurality of swirl vanes are mounted around the central axis and are angularly disposed relative to the general flow direction with inner edges of the vanes spaced equilaterally around and connected to the central element and outer edges connected to the inside surfaces of the choke body. The vanes cause the stream of primary air and pulverized fuel to rotate rapidly around the central axis as the stream passes through the outlet end.

20 Claims, 3 Drawing Sheets

FLAME RETAINING NOZZLE TIP

BACKGROUND OF THE INVENTION

1. Field of the Invention

The present invention relates to a new and improved flame retaining nozzle tip for a burner in a pulverized fuel fired furnace. More particularly the present invention relates to a flame retaining nozzle tip designed to be used for burner retrofit applications in both wall fired furnaces as well as tangentially fired furnaces. The new and improved nozzle tip provides improved flame retention and stability without premature burn up and provides better turn down characteristics allowing low load operation with little or no support fuel being required. More specifically a new and improved flame retaining nozzle tip of the present invention is especially well adapted for use in burner retrofit applications and provides much improved loss on ignition characteristics (LOI) and high efficiency operation for a retrofitted coal burner over a wide range of loads.

2. Background of the Prior Art

U.S. Pat. No. 4,348,170 discloses a dual register, split-stream, burner assembly with a flow dividing cone.

U.S. Pat. No. 4,356,975 discloses a nozzle tip for a pulverized coal burner having splitter vanes provided with abrasion-resistant and heat-resistant material.

U.S. Pat. No. 4,520,739 discloses a nozzle tip for a pulverized coal burner employing three interconnected components including a temperature-resistant end cap, a base or body and a replaceable abrasion-resistant insert between the body and the end cap.

U.S. Pat. No. 5,257,927 discloses a low $NO_x$ burner employing a plurality of gas nozzles which individually inspirate a portion of the combustion air and the burner includes a spin vane diffuser to rotate and mix the gases within the primary combustion zone.

U.S. Pat. Nos. 4,479,442 and 4,457,241 owned by the assignee of the present application and incorporated herein by reference, disclose a high efficiency pulverized fuel burner for furnaces receiving a flowing stream of pulverized coal and primary air. The burner includes a Venturi mounted adjacent an outlet end of a coal nozzle and has a conical flow spreader and swirl vanes. The spreader cone is mounted in an outlet end divergent flow section of the Venturi structure and form an annular expanding flow pattern of the coal and primary air mixture as it is discharged into the combustion zone of a furnace. These burners have been found to greatly improve $NO_x$ reduction characteristics and the new and improved flame retaining nozzle tip in accordance with the present invention can be utilized in combination with the low $NO_x$ Venturi burner of U.S. Pat. Nos. 4,479,442 and 4,457,241 to further improve the operating characteristics.

OBJECTS OF THE INVENTION

It is an object of the present invention to provide a new and improved flame retaining nozzle tip for a burner utilizing pulverized fuel such as coal.

It is another object of the present invention to provide a new and improved flame retaining nozzle tip for a burner using pulverized fuel and mounted in a tangentially fired furnace.

It is yet another object of the present invention to provide a new and improved flame retaining nozzle tip which provides greater flame stability without premature burn up.

Yet another object of the present invention is to provide a new and improved flame retaining nozzle tip which allows better turn down characteristics and lower load operation with little or no support fuel being required.

Still another object of the present invention is to provide a new and improved flame retaining nozzle tip of the character described which provides improved loss on ignition (LOI) characteristics resulting in less unburned carbon.

Still another object of the present invention is to provide a new and improved flame retaining nozzle tip which ensures that the flame remains attached to the nozzle tip outlet so that more combustion time is provided for the fuel to burn resulting in more complete combustion.

Yet another object of the present invention is to provide a new and improved flame retaining nozzle tip especially designed for retrofitting and upgrading existing pulverized fuel fired burners.

BRIEF SUMMARY OF THE PRESENT INVENTION

The foregoing and other objects and advantages of the present invention are accomplished in a new and improved flame retaining nozzle tip especially designed for burners utilizing pulverized fuel and mounted in a corner windbox of a furnace for tangential firing into combustion zone. The new and improved flame retaining nozzle tip is supported for tilting movement about a transverse horizontal tilt axis at the end of a coal and primary air pipe for receiving a stream of pulverized fuel for discharge into a combustion zone of a furnace. The nozzle tip includes hollow, open-ended choke structure having an inlet end of generally polygonal flow cross-section for receiving the stream of primary air and coal and an outlet end of generally rounded cross-section for. accelerating and discharging the stream into the combustion zone. The outlet end of the choke has a flow cross-section which is smaller in area than that of the inlet end so that velocity of the stream is increased as the pulverized coal and air stream is discharged into the combustion zone. An elongated center element is mounted in coaxial alignment with a central axis of the choke extending between the inlet and outlet end. A plurality of swirl vanes are mounted around the central axis and each vane has an outer end portion angularly disposed relative to the general direction of flow having inner edges spaced equilaterally around and connected to the central element. Each vane has outer edges connected to the inside surface of the choke or body. The swirl vanes slope relative to the general flow direction causing a rapid rotation of the primary coal and air stream around the central axis as the stream reaches the outlet end. An outer, choking, flow containment shroud is provided outside the choke body for accelerating and discharging a stream of secondary combustion around the swirling primary coal/air stream from the central choke body. The surrounding discharge of secondary air further ensures flame stability and retention on the outlet end of the nozzle tip resulting in greatly improved combustion characteristics.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 10:
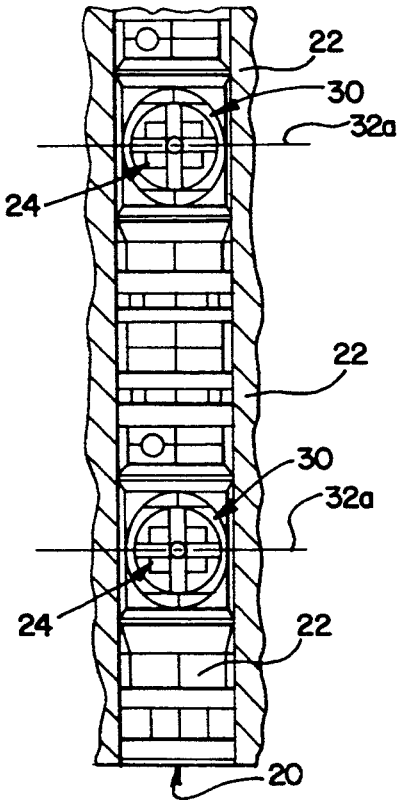
FIG. 10 is an outlet or frontal elevational view taken substantially along lines 10—10 of FIG. 9 illustrating the outlet side of the windbox and the flame retaining nozzle tips in accordance with the present invention.
Figure 9:
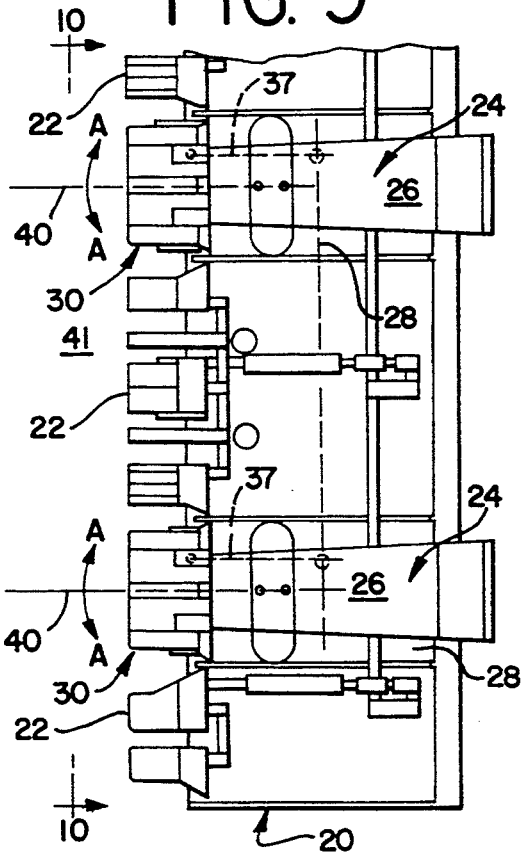
FIG. 9 is a side elevational view of a typical vertical windbox installation on a tangentially fired furnace utilizing pulverized fuel and retrofitted with one or more flame retaining nozzle tips in accordance with the present invention.

Referring now more particularly to the drawings, therein is illustrated in FIGS. 9 and 10, a vertical windbox 20 of the type utilized in tangentially fired furnaces and located at the corners of the furnace. The windbox 20 typically includes a plurality of vertically spaced apart air nozzles 22 in a vertically stacked array for delivering secondary air into a combustion zone of a furnace. A plurality of pulverized coal fired burners 24 are mounted at several elevations intermediately and between the air nozzles 22. Each coal burner 24 is supplied with a stream of pulverized coal and primary combustion air from a coal mill or the like (not shown) through a primary coal/air pipe 26 extending into a hollow fuel burner containing compartment 28 (FIG. 9), which compartment is supplied with secondary combustion air from the windbox 20 in a known manner.

Figure 3:
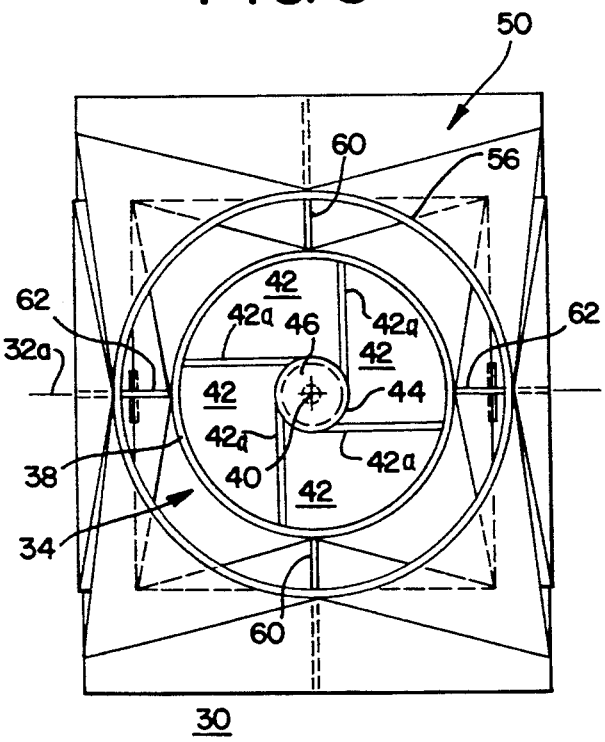
FIG. 3 is an outlet end or frontal elevational view of a new and improved flame retaining nozzle tip in accordance with the present invention.
Figure 4:
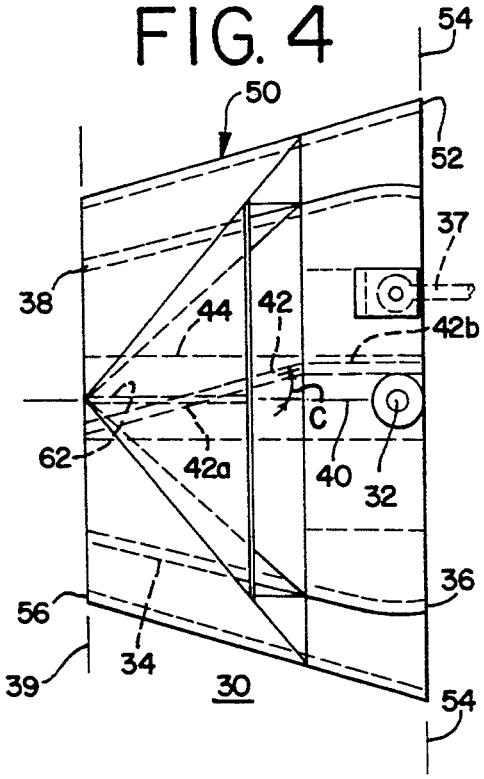
FIG. 4 is a side elevational view of the nozzle tip of FIG. 3.
Figure 5:
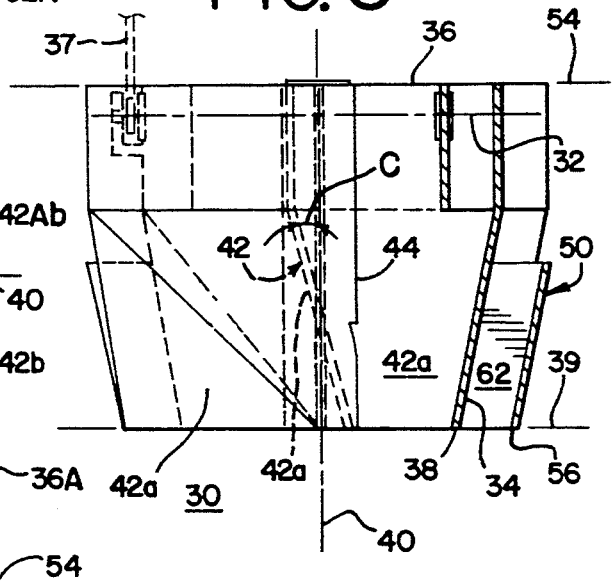
FIG. 5 is a composite, top plan view and central horizontal cross-sectional view of the nozzle tip.

In accordance with the present invention, the coal burners 24 are provided with a new and improved flame retaining nozzle tip 30 constructed in accordance with the features of the present invention and illustrated in enlarged detail in FIGS. 3–5. The nozzle tips 30 are designed for tilting movement relative to an outlet end 24*a* of the coal burners 24 and are supported for tilting movement about a transverse horizontal axis 32*a* on coaxial mounting pins or axles 32 on opposite side walls of the coal/air pipe 26 to support the nozzle tips 30 for vertical tilting movement (Arrows A, FIG. 1) as controlled by an arm 37 of control tilt mechanisms as known in the art.

In accordance with the present invention, the nozzle tip 30 includes a hollow, open-ended, body or choke 34 having an inlet end 36 of polygonal or rectangular-shaped flow cross-section that is adapted and aligned to receive the flow of pulverized coal and primary combustion air from the outlet end 24*a* of a coal burner 24. The choke body 34 includes an outlet end 38 of rounded or circular flow cross-section which has an area measured on a plane 39 normal to a longitudinal central axis 40 of the body extending between the inlet end 36 and outlet end 38 that is smaller than the cross-sectional area of flow at the inlet end 36 also measured on the plane 39 normal to the longitudinal central axis 40. Because of the differences in cross-sectional flow area between the inlet end 36 and the outlet end 38 of the choke body 34, the nozzle tip 30 provides a choking action on the primary coal/air stream introduced from the coal pipe 26 and the velocity of this stream is increased to a maximum value as it reaches the outlet end 38 flowing into a combustion zone 41 (FIGS. 1, 2 and 9) of a furnace.

Because the cross-sectional flow area at the outlet end 38 is smaller than the cross-sectional flow area at the inlet end 36 of the central choke body 34, the primary coal/air stream is accelerated as it exits the nozzle tip 30. In addition, because the flow cross-section changes from a polygonal or rectangular shape at the inlet end 36 to a rounded or circular shape at the outlet end 38, the stream of primary coal/air converges and becomes tighter and more compact in size as the velocity increases.

In accordance with the invention, the high velocity convergent primary coal/air stream is deflected to swirl about the central axis 40 by a plurality of swirl vanes 42, having longitudinally extending inner edges secured to a centrally disposed cylindrical element 44 in coaxial alignment with the central axis 40 as shown in FIGS. 3–5. The swirl vanes 42 are equilaterally disposed around the center element 44 and extend in a generally tangential direction outwardly thereof as shown in FIG. 3. Outer longitudinal edges of the swirl vanes 42 are joined to the inside surface of the choke body 34 and the vanes 42 divide the primary coal/air stream into a plurality of part streams around the central axis 40, which part streams converge toward the central axis 40 toward the outlet end 38 of the choke body 34.

In accordance with the present invention, forward or outlet end portions 42a of the swirl vanes 42 are sloped at a swirl angle C (FIG. 4) relative to the general direction of flow through the coal pipe 26 and rearward portion of the choke body 34 generally parallel of the control axis 40. As illustrated in the embodiment of FIGS. 3–5, the amount of slope represented by the angle C may be approximately 15° and the amount of this slope determines the tightness of the spirally flowing primary coal/air stream adjacent the outlet end 38 of the choke body 34 and is an important factor in assuring flame stability and flame retention at the outlet end of the tip of the nozzle 30.

Each swirl vane 42 may also include a rearward portion 42*b* extending longitudinally and radially outward of the central support element 44. In addition to providing angular deflecting surfaces 42a for imparting swirling action to the primary coal/air stream, the swirl vanes 42 also provide structural interconnection between the center element 44 and the choke body 34 so that a strong tip structure guide is formed. The cylindrical center element 44 is hollow and has a diameter large enough to accommodate a gas pilot or starting gas burner when required or may be smaller in diameter as needed. In a larger diameter element 44, an outer end may be closed off with a circular cap 46 (FIG. 3) aligned with the outlet end plane 39.

Figure 2:
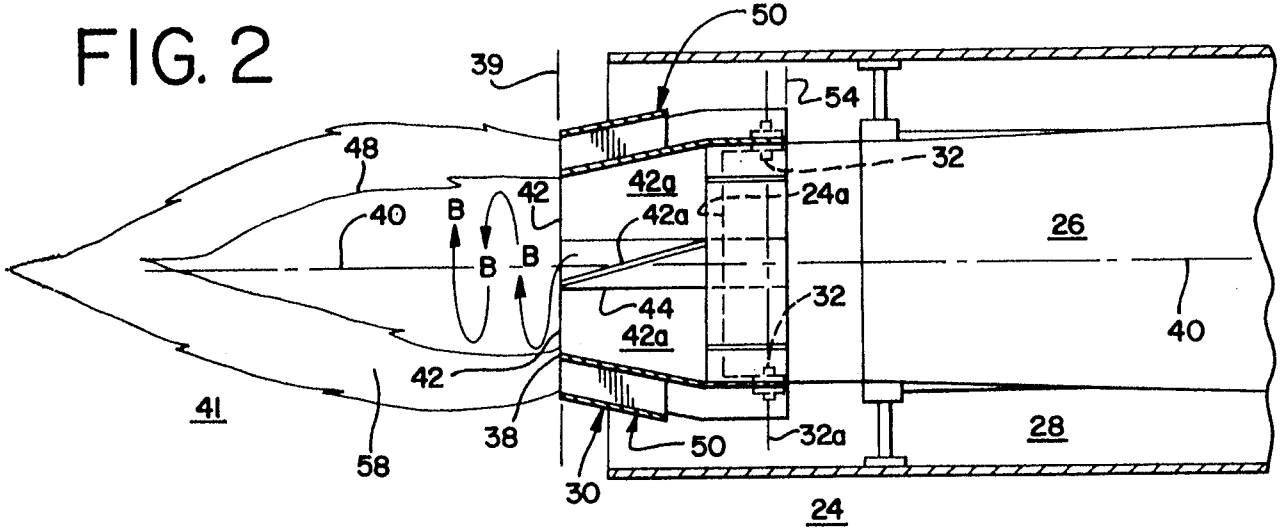
FIG. 2 is a cross-sectional view taken substantially along lines 2—2 of FIG. 1.
Figure 1:
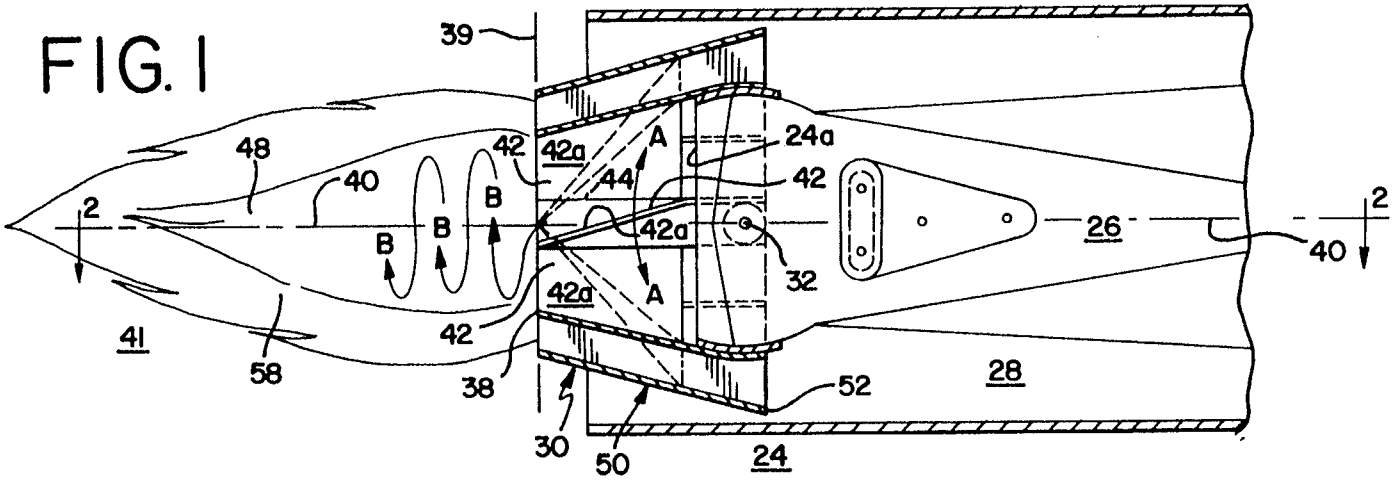
FIG. 1 is a longitudinal elevational cross-sectional view of a burner for a pulverized fuel fired furnace employing a flame retaining nozzle tip constructed in accordance with the features of the present invention.

Referring to FIGS. 1 and 2, because of the intense swirling action (Arrows B) imparted by the swirl vanes 42 to the high velocity part streams of the centrally disposed primary coal/air swirl, a very stable flame pattern 48 obtains at the rounded or circular outlet end 38 of the central choke body 34. Because of the swirling action (Arrows B), the flame pattern 48 is shorter in length and because of the high velocity and tight spiral flow, more burning time is provided for the coal particles even though the overall length of the flame pattern 48 in the direction of the axis 40 is relatively short.

Moreover, a more efficient and complete combustion process and better carbon burnout obtains with the nozzle tips 30 than with other types of tip structures. Greatly improved LOI characteristics are also present with the nozzle tips 30 and the improved flame pattern, stability and retention that is provided permits better control during turn down with little or no support fuel being required.

In accordance with the present invention, the new and improved nozzle tip 30 includes an outer choke or shroud 50 for secondary combustion air received from the windbox chamber 28 around the primary coal/air pipe 26. The outer choke 50 has a body aligned in coaxial alignment with the central axis 40 of the inner choke body 34. The outer choke or shroud 50 has an inlet end 52 having a generally polygonal or rectangular-shaped flow cross-section aligned on a common plane 54 with the inlet end 36 of the central choke body 34 and normal to the central axis 40 of the nozzle tip 30. The shroud 50 has an outlet for forward end 56 of rounded or circular flow cross-section which is aligned on the plane 39 with the outlet end 38 of the central choke body 34.

The cross-sectional flow area for secondary combustion air defined on the plane 54 between the rectangular-shaped inlet ends 52 and 36 of the central body 34 and the outer shroud 50, respectively, is greater than the cross-sectional flow area defined on the outlet plane 39 between the concentric outlet ends 56 and 38, respectively, so that the flow of secondary air through the outer shroud is choked or accelerated and convergently directed toward the central axis 40 for discharge at the outlet end plane 39 annularly surrounding the flame pattern 48 produced by the central primary coal/air stream discharged from the outlet end 38 of the central choke body 34. The secondary combustion air from the shroud 50 provides a protective, generally conically-shaped sheath 58 around the flame pattern 48 adding even more flame stabilization and flame retention properties. Moreover, the surround sheath 58 of secondary combustion air tends to shorten the length of the primary flame pattern 48 and helps to insure efficient combustion of the coal particles in the primary coal/air streams burning in the zone or region of the flame pattern 48. The shroud 50 is interconnected to the outer surface of the central choke body 34 by means of upper and lower vertical separator vanes 60 and by lateral or side vanes 62. The vanes 60 and 62 divide the secondary air stream flowing through the outer choke 50 into a plurality of high velocity convergent part streams discharging from the outlet end 56 around the flame pattern 48.

Figure 8:
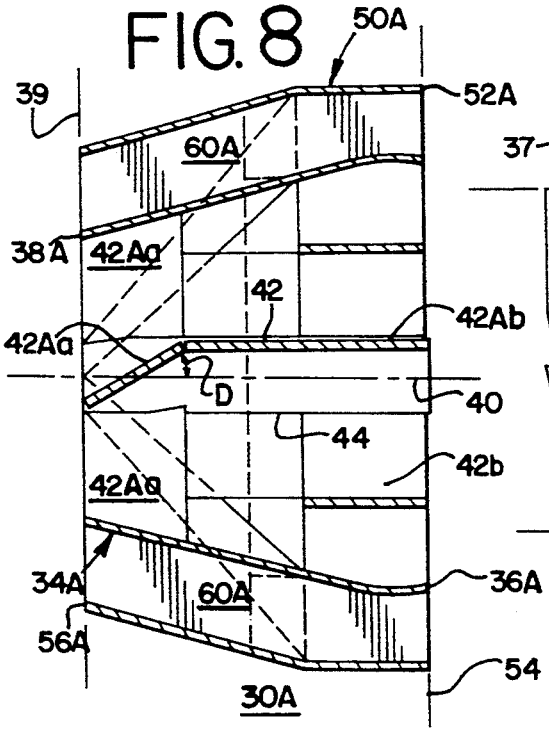
FIG. 8 is a longitudinal cross-sectional view of the nozzle tip taken substantially along lines 8—8 of FIG. 6.
Figure 6:
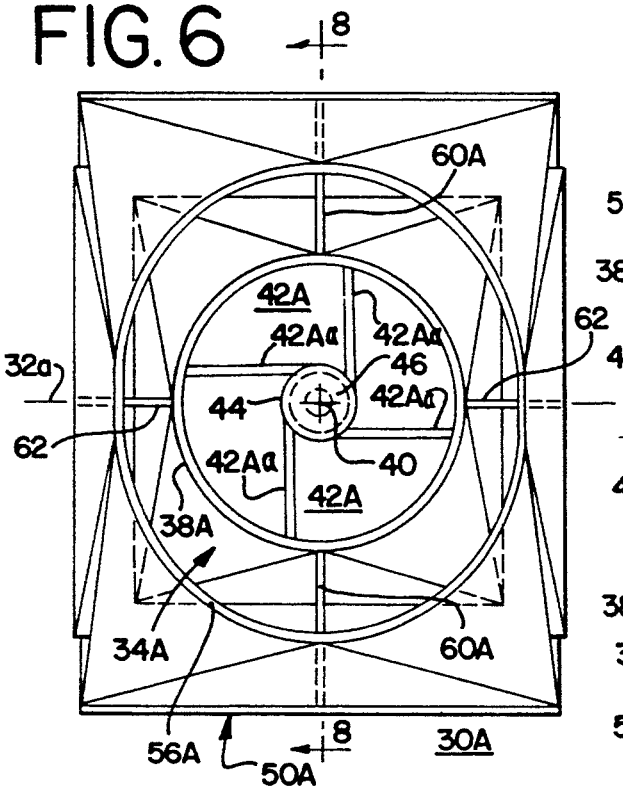
FIG. 6 is an outlet end or frontal elevational view of another embodiment of a flame retaining nozzle tip in accordance with the features of the present invention.
Figure 7:
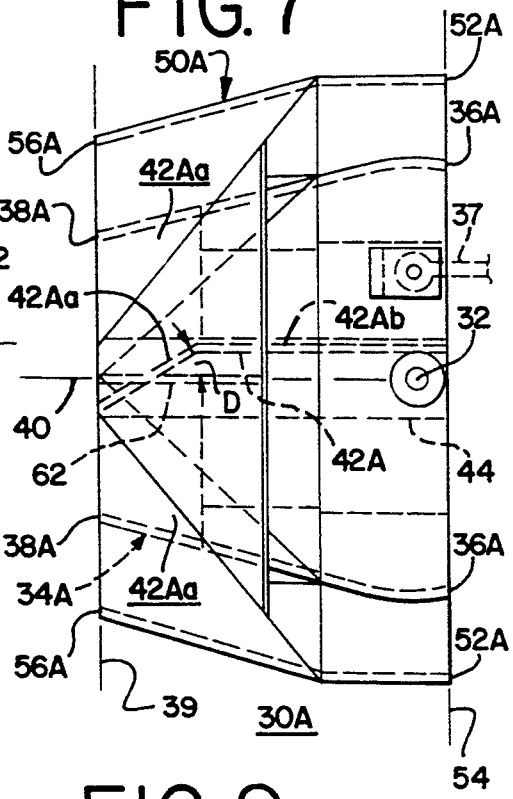
FIG. 7 is a side elevational view of the nozzle tip of FIG. 6.

Referring now to FIGS. 6–8, therein is illustrated a modified form of nozzle tip 30A which is generally similar in concept, structure and operation to the nozzle tip 30 just described and only the differences between the two embodiments will be pointed out herein. Instead of a circular-shaped outlet end 38 as in the nozzle tip 30, the nozzle tip 30A has an outlet end 38A of oval or elliptical shape so that choking action in a horizontal plane is slightly less than in a vertical plane rather than even all around the central axis 40. This arrangement permits retrofitting in windboxes having dimensional constraints and also provides a capability to fan out the shape of the flame pattern 48 greater or lesser amounts in different planes to accommodate different furnace dimensions and environments.

The nozzle tip 30A includes a plurality of swirl vanes 42A similar to the swirl vanes 42 of the nozzle tip 30 but of somewhat different shapes because of the oval or elliptical flow cross-section of the outlet end 38A of the inner choke body 34A. In addition, forward end portions 42Aa of the swirl vanes 42A are arranged at an angle D (FIGS. 7–8) which is approximately 30° relative to general direction of fluid flow generally parallel of the central axis 40. The greater slope angle of 30° provides for a more intense swirling action than the 15° slope of the vanes 42 of the nozzle tips 30 previously described. It is also to be noted that the slope angle may vary between 15° and 30° as needed for particular velocity and loading ranges for furnace environments of different categories.

The nozzle tip 30A of FIGS. 6–8 includes an outer, choking, shroud 50A for secondary combustion air having an oval or elliptically-shaped flow cross-section at an outlet end 56A on the outlet plane 39 surrounding the outlet end 38A of the inner choke body 34A and in concentric alignment therewith on the central axis 40. The shroud 50A has a flow cross-section on an inlet plane 54 of generally rectangular shape at an inlet end 52A which surrounds a smaller size inlet end 36A of the central choke body 34A. The flow cross-sectional area measured on the inlet end plane 54 between the shroud 50A and the central choke body 34A is greater than the cross-sectional flow area between the shroud and central choke body measured on the outlet end plane 39. Accordingly, the flow of secondary combustion air through the shroud 50A around the central choke body 34A is constructed to increase the flow velocity and directs the stream of secondary air to converge inwardly toward the central axis 40 toward the outlet end plane 39 as in the nozzle tip 30 previously described. The flow of secondary combustion air through the shroud 50A surrounds and adds stability to the plane pattern 48 and forms a protective envelope or shield 58 around the central flame as previously described.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A flame retaining nozzle tip for a burner for a pulverized fuel-fired furnace receiving a primary stream of pulverized fuel and air for discharge into a combustion zone of said furnace, comprising:

a hollow, open-ended body having an inlet end of generally rectangular flow cross-section for receiving said stream and an outlet end of generally circular cross-section for discharging said stream having a flow cross-section area less than that of said inlet end;

a cylindrical center element in coaxial alignment with a central axis extending between said inlet end and said outlet end; and a plurality of swirl vanes around said central axis angularly disposed relative thereto having inner edges spaced equilaterally around and connected to central element and having outer edges connected to an inside surface of said hollow body for causing said stream to rotate rapidly around said central axis passing through said outlet end of said hollow body.

2. The nozzle tip of claim 1, wherein:

said swirl vanes extend outwardly of said center element toward said hollow body and have outer end portions which slope at a relatively shallow angle relative to the general flow direction of said stream upstream of said inlet end.

3. The nozzle tip of claim 2, wherein:

said shallow angle is approximately 15° as measured between deflecting surfaces of said swirl vanes and said central axis.

4. The nozzle tip of claim 2, wherein:

said shallow angle is approximately 30° as measured between deflecting surfaces of said swirl vanes and said central axis.

5. The nozzle tip of claim 1, wherein:

said swirl vanes are tangent to cylindrical center element along said inner edges which are joined thereto.

6. The nozzle tip of claim 1, including:

an outer flow containment wall for a surrounding outer stream of secondary air spaced outwardly of and extending around said open-ended body, said containment wall having an inlet end of generally rectangular shape in coaxial alignment with said inlet end of said hollow body and an outlet end of generally circular shape in coaxial alignment with said outlet end of said hollow body.

7. The nozzle tip of claim 6, including:

a plurality of support vanes at spaced apart positions on said hollow body extending outwardly thereof to support said flow containment wall.

8. The nozzle tip of claim 6, wherein:

a flow cross-sectional area between said inlet ends of said hollow body and said flow containment wall for said outer stream of secondary air is greater than a flow cross-sectional area between said outlet ends of said hollow body and said flow containment wall.

9. The nozzle tip of claim 6, wherein:

said outlet ends of said hollow body and said flow containment wall are on a common plane normal to central axis.

10. The nozzle tip of claim 9, wherein:

said cylindrical center element has an outlet end on said common plane.

11. A flame retaining nozzle tip for a burner for a pulverized fuel-fired furnace receiving a primary stream of pulverized fuel and air for discharge into a combustion zone of said furnace, comprising:

a hollow, open-ended choke having an inlet end of generally polygonal flow cross-section for receiving said stream and an outlet end of generally rounded cross-section for accelerating and discharging said stream into said furnace and having a flow cross-section area less than that of said inlet end;

an elongated center element in coaxial alignment with a central axis extending between said inlet end and said outlet end; and a plurality of swirl vanes around said central axis angularly disposed relative thereto having inner edges spaced equilaterally around and connected to central element and having outer edges connected to an inside surface of said choke for causing said stream to rotate rapidly around said central axis passing through said outlet end of said choke.

12. The nozzle tip of claim 11, wherein:

said swirl vanes extend outwardly of said center element toward said choke and have outer end portions which slope at a relatively shallow angle relative to the general flow direction of said stream upstream of said inlet end.

13. The nozzle tip of claim 12, wherein:

said shallow angle is approximately 15° as measured between deflecting surfaces of said swirl vanes and said central axis.

14. The nozzle tip of claim 12, wherein:

said shallow angle is approximately 30° as measured between deflecting surfaces of said swirl vanes and said central axis.

15. The nozzle tip of claim 11, wherein:

said swirl vanes are tangent to center element along said inner edges which are joined thereto.

16. The nozzle tip of claim 11, wherein:

said inlet end has a rectangular flow cross-section normal to said central axis and said outlet end has an oval-shaped flow cross-section normal to said central axis.

17. The nozzle tip of claim 1, including:

an outer, choking, flow containment shroud for accelerating and discharging around said primary stream a surrounding outer stream of secondary air spaced outwardly of and extending around said choke, said shroud having an inlet end of generally rectangular shape in coaxial alignment with said inlet end of said choke and an outlet end of generally oval shape in coaxial alignment with said outlet end of said choke.

18. The nozzle tip of claim 17, including:

a plurality of support vanes at spaced apart positions on said choke extending outwardly to support said shroud.

19. The nozzle tip of claim 17, wherein:

a flow cross-sectional area between said inlet ends of said choke and said shroud for said outer stream of secondary air is greater than a flow cross-sectional area between said outlet ends of said choke and said shroud.

20. The nozzle tip of claim 17, wherein:

said outlet ends of said choke and shroud wall are normal to central axis.

* * * * *